United States Patent [19]

Nakagawa

[11] 3,979,901

[45] Sept. 14, 1976

[54] CONSTRUCTION OF THE GEAR TRAIN FOR A TIMEPIECE

[75] Inventor: Yasuichi Nakagawa, Tokyo, Japan

[73] Assignee: Kabushiki Kaisha Daini Seikosha, Japan

[22] Filed: Feb. 26, 1975

[21] Appl. No.: 553,288

[30] Foreign Application Priority Data

Feb. 26, 1974 Japan ..... 49-22539

[52] U.S. Cl. ..... 58/59

[51] Int. Cl.[2] ..... G04B 33/00

[58] Field of Search ..... 58/7, 59

[56] References Cited

UNITED STATES PATENTS

| | | | |
|---|---|---|---|
| 2,574,343 | 11/1951 | Meyer | 58/59 |
| 2,872,775 | 2/1959 | Maire | 58/59 |
| 2,990,676 | 7/1961 | Jensen | 58/59 X |
| 3,208,210 | 9/1965 | Storz | 58/59 |

*Primary Examiner*—George H. Miller, Jr.
*Attorney, Agent, or Firm*—Robert E. Burns; Emmanuel J. Lobato; Bruce L. Adams

[57] ABSTRACT

A construction of the gear train for a timepiece comprises a minute wheel, a third wheel and a fifth wheel, at least one of said wheels being coaxially and freely mounted on a common axle with the other of said wheels whereby the whole of said gear train is compactly constructed.

3 Claims, 3 Drawing Figures

CONSTRUCTION OF THE GEAR TRAIN FOR A TIMEPIECE

BACKGROUND OF THE INVENTION

This invention relates to a construction of the gear train for a timepiece, at least one wheel thereof being coaxially and freely mounted on a common axle with other wheels.

In a conventional type of gear train driven by a stepping motor having a two-poled rotor, said rotor is driven 1/2 rotation per one second and further driven 30 rotations per one minute. On the other hand, a second hand axis (a fourth gear wheel) is driven 1 rotation per one minute so that the rotary speed ratio between a rotor axis and said second hand axis is set at 1 : 30. Therefore, the gear ratio for coupling said rotor axis and said second axis using one step coupling of a gear system must be set at 30 : 1.

In general, a realization of the gear ratio of 30 : 1 using said one step coupling is very difficult in conventional engineering.

Accordingly, the other gear wheel (an intermediate coupling gear) for a gear reduction must be mounted on a separate axle between said second hand axle and rotor axle in view of the manufacturing of a gear wheel. However, it is very difficult to construct a small watch in view of the large spaces needed to accommodate the battery, a crystal quartz block and a circuit block.

Therefore, it will be lacking of the commodity value as a watch for women and men.

OBJECT OF THE INVENTION

The present invention aims at eliminating the above noted difficulty and insufficiency, and therefore it is a primary object of the present invention to provide a construction of gear train for a timepiece, said gear train comprising: a minute wheel, a third wheel and a fifth wheel, at least one of said wheels being coaxially and freely mounted on the same common axle as the others of said wheels.

Another object of the invention is to provide a small gear train for enabling the manufacture of small crystal quartz watches.

Further object of the invention is to provide a reasonable frame working for a watch which is easily made by the simplification of said gear train, the manufacturing of parts and the effective arrangement including a battery, a crystal quartz block and a circuit block.

SUMMARY OF THE INVENTION

According to the present invention, there is provided a construction of a gear train for a timepiece, said gear train comprising a minute wheel, a third wheel and a fifth wheel, at least one wheel in said wheels is coaxially and freely mounted to said one wheel in said wheels. Whereby a whole of said gear train is compactly constructed.

BRIEF DESCRIPTION OF THE DRAWINGS

The above mentioned and further object, features and advantages of the present invention will become more obvious from the following description when taken in connection with the accompanying drawings, which shows one preferred and another preferred embodiments of the invention, and wherein.

DETAILED DESCRIPTION OF THE INVENTION

Referring now to the accompanying drawings, the embodiments of this invention are explained with reference to a construction of a gear train for a timepiece.

Figure 1:
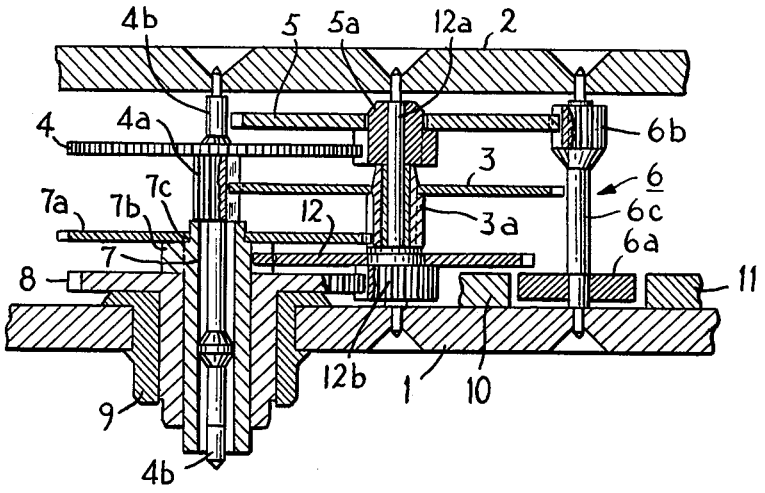
FIG. 1 shows a cross sectional view of a partial construction according to this invention.

In FIG. 1, a third wheel 3 and a fifth wheel 5 are rotatable mounted on a common axle 12*a*, and a minute wheel 12 is fixedly mounted to said axle 12*a*. Numeral 1 shows a base plate, and 2 is a gear train bearing plate. A rotor axle 6*c*, said central axle 12*a* and a second hand axle 4*b* are respectively and rotatable mounted by said plates 1 and 2. A rotor pinion 6*b* of said rotor axle 6*c* is geared to a fifth wheel 5 which is freely mounted on said common axle 12*a*, a fifth wheel pinion 5*a* of said fifth wheel 5 is geared to a fourth wheel 4 which is fixedly mounted to the second hand axle 4*b*, and a fourth wheel pinion 4*a* of said fourth wheel 4 is geared to third wheel 3 which is fixedly mounted to a third wheel pinion 3*a* which is freely mounted on said axle 12*a*. Said third wheel pinion 3*a* is geared to a minute gear wheel 7*a* which is frictionally mounted on a L-shaped step portion 7*c* of a pinion 7*b*, said pinion 7*b* of a center minute wheel 7 is geared on a minute wheel 12 which is fixedly mounted to said axle 12*a*, and said minute wheel pinion 12*b* is geared to an hour wheel 8. By such a construction,said second hand axle 4*b*, said center minute wheel 7 and said hour wheel 8 are respectively rotated in timed relationship.

Numeral 9 is a pipe which functions as a guide member for said hour wheel 8 which is mounted on said base plate 1, further numerals 10 and 11 are stators for a magnet rotor 6 which is fixedly mounted to said rotor axle 6*c*, and the core member, drive coil and other parts of the stepping motor are not shown as they are of well known construction and form as part of the present invention. Further, the reduction gear ratio of said rotor pinion 6*b* and said fourth wheel 4 is not 1/30, the gear ratio of said fourth wheel pinion 4*a* and said minute gear wheel 7*a* is set at 1/60.

Referring now to the operation of said construction, high frequency pulses of 16KHz and 32KHz produced by a crystal quartz oscillator are changed to a 1Hz signal by a conventional dividing circuit composed of MOS-IC (not shown). A reversible pulse signal having a certain shape and amplitude for driving said rotor 6 is derived and applied to the drive coils of said cores (not shown) so that magnetic fields of S.N. poles and N.S. poles are alternately produced in the end portions of said stators 10 and 11 to rotationally drive said rotor 6 in stepwise increments of 180°. This rotary power of said rotor 6 is transmitted to said fifth wheel 5 and said fourth wheel 4, whereby said second hand axle 4*b* is rotated. Said third wheel 3 is driven by said fourth wheel pinion 4*a*. Said center minute wheel 7 is driven by said third wheel pinion 3*a* via said minute gear wheel 7*a*, said minute wheel 12 is rotated by said cannon pinion 7*b*, and said hour wheel 8 is rotated by said minute wheel pinion 12*b* of said minute wheel 12.

Figure 2:
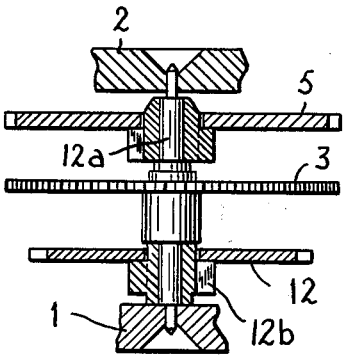
FIG. 2 and FIG. 3 respectively show a partial cross sectional view of other embodiments according to this invention.
Figure 3:
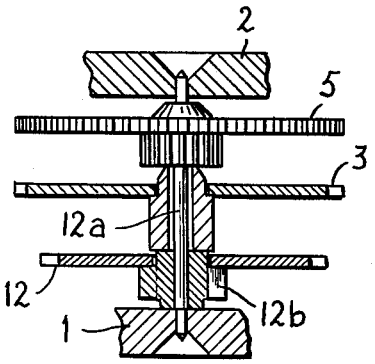

FIG. 2 and FIG. 3 show the other embodiments of this invention.

In FIG. 2, said third wheel 3 is fixedly mounted on said central axle 12*a*, said fifth wheel 5 is freely mounted on the upper portion of said common axle 12*a*, and said minute wheel 12 is freely mounted on the lower portion said axle 12*a*.

In FIG. 3, said fifth wheel 5 is fixedly mounted on said common axle 12*a*, said third wheel 3 is freely mounted on said axle 12*a*, and said minute wheel 12 is freely mounted on said axle 12*a*. Accordingly, said gear train of this invention is simplified, and space which contains said fifth wheel and minute wheel is smaller as compared to the conventional type.

The construction of the invention enables an effective arrangement of said battery, crystal quartz block and circuit block to be attained due to the reduction in space factor, and further the manufacturing of the parts are easily made. Therefore crystal quartz watches of small size for men and women which are equal to those of the conventional type in a function, can be easily made.

What we claimed is:

1. A construction of a gear train for a timepiece, comprising, in combination: a base plate and a gear train bearing plate disposed in spaced relationship; a rotor axle, common axle, and second hand axle rotatably mounted between said base plate and said gear train bearing plate; a rotor pinion and a magnet rotor mounted on said rotor axle; a fourth wheel mounted on said second hand axle; a minute wheel fixedly mounted on said common axle; and third and fourth wheels freely mounted on said common axle.

2. A construction of a gear train for a timepiece, comprising, in combination: a base plate and a gear train bearing plate disposed in spaced relationship; a rotor axle, common axle and second hand axle rotatably mounted between said base plate and said gear train bearing plate; a rotor pinion and a magnet rotor mounted on said rotor axle; a fourth wheel mounted on said second hand axle; a third wheel fixedly mounted on said common axle; and fifth and minute wheels freely mounted on said common axle.

3. A construction of a gear train for a timepiece, comprising, in combination: a base plate and a gear train bearing plate disposed in spaced relationship; a rotor axle, common axle and second hand axle rotatably mounted between said base plate and said gear train bearing plate; a rotor pinion and a magnet rotor mounted on said rotor axle; a fourth wheel mounted on said second hand axle; a fifth wheel fixedly mounted on said common axle; and third and minute wheels freely mounted on said common axle.

* * * * *